US006916388B1

(12) United States Patent
Louwers et al.

(10) Patent No.: US 6,916,388 B1
(45) Date of Patent: Jul. 12, 2005

(54) HYDRAZINIUM NITROFORMATE BASED HIGH PERFORMANCE SOLID PROPELLANTS

(75) Inventors: Jeroen Louwers, Waalre (NL); Antonius Eduard Dominicus Maria Van Der Heijden, Den Haag (NL); Petrus Johannes Maria Elands, Gouda (NL)

(73) Assignee: Nederlandse Organisatie voor toegepast-natuurwetenschappelijk Onderzoek TNO (NL)

( * ) Notice: Subject to any disclaimer, the term of this patent is extended or adjusted under 35 U.S.C. 154(b) by 0 days.

(21) Appl. No.: 09/700,325

(22) PCT Filed: May 19, 1999

(86) PCT No.: PCT/NL99/00307

§ 371 (c)(1),
(2), (4) Date: Mar. 16, 2001

(87) PCT Pub. No.: WO99/59940

PCT Pub. Date: Nov. 25, 1999

(30) Foreign Application Priority Data

May 20, 1998 (EP) ..... 98201696

(51) Int. Cl.[7] ..... C06B 45/10; C06B 47/08
(52) U.S. Cl. ..... 149/19.4; 149/19.9; 149/36
(58) Field of Search ..... 149/19.4, 19.9, 149/36

(56) References Cited

U.S. PATENT DOCUMENTS

| | | | | | |
|---|---|---|---|---|---|
| 3,658,608 | A | | 4/1972 | Low et al. | |
| 3,708,359 | A | | 1/1973 | Low et al. | |
| 3,837,940 | A | * | 9/1974 | Spenadel et al. | 149/36 |
| 4,428,785 | A | * | 1/1984 | Suzuki et al. | 149/19.4 |
| 4,658,578 | A | * | 4/1987 | Shaw | 149/19.4 |
| 4,938,814 | A | * | 7/1990 | Schoyer et al. | 149/19.9 |
| 5,320,692 | A | | 6/1994 | Burdette et al. | |
| 5,472,532 | A | * | 12/1995 | Wallace, II | 149/19.4 |
| 5,557,015 | A | * | 9/1996 | Zee et al. | 564/464 |
| 5,837,930 | A | * | 11/1998 | Mul et al. | 149/19.4 |
| 6,362,311 | B1 | * | 3/2002 | Highsmith et al. | 525/333.1 |

FOREIGN PATENT DOCUMENTS

| | | |
|---|---|---|
| EP | 0 194 180 | 9/1986 |
| EP | 0 350 135 | 1/1990 |
| GB | 2 228 731 A | 9/1990 |
| WO | WO 94/10104 A | 5/1994 |

OTHER PUBLICATIONS

Schoyer, H.F.R., et al.: "High–performance propellants based on hydrazinium nitroformate" Chemical Abstracts, vol. 123, No. 22, p. 324, Nov. 27, 1995 Columbus, Ohio, US; abstract No. 291160m. XP 000663426.

Hordijk, A.C., et al.: "Properties of hydrazine nitroformate; a "new" oxidizer for high performance solid propellants." Chemical Abstracts, vol. 122, No. 2, p. 187, Jan. 9, 1995 Columbus, Ohio, US; abstract No. 13156t. XP 000660506.

Anan, Toshiyuki, et al.: "Physical and chemical properties of HNF" Chemical Abstracts, vol. 123, No. 14, p. 281, Oct. 2, 1995 Columbus, Ohio, US; abstract No. 174351p, XP 000663569.

* cited by examiner

*Primary Examiner*—Aileen Felton
(74) *Attorney, Agent, or Firm*—Muserlian, Lucas and Mercanti, LLP

(57) ABSTRACT

The present invention is directed to a solid propellant for rocket motors, gas generators and comparable devices, comprising a cured composition of hydrazinium nitroformate and an unsaturated hydroxyl terminated hydrocarbon compound.

15 Claims, No Drawings

HYDRAZINIUM NITROFORMATE BASED HIGH PERFORMANCE SOLID PROPELLANTS

The present invention is directed to solid propellants for rocket motors, gas generators and comparable devices, based on a high energetic oxidizer, combined with a binder material.

Solid propellant combinations are prepared by blending solid oxidizers such as ammonium perchlorate or hydrazinium nitroformate with a liquid precursor for the matrix material. By curing of the binder a solid propellant is obtained, consisting of a polymer matrix and oxidiser in the form of solid inclusions.

For ammonium perchlorate quite often liquid hydroxyl terminated polybutadienes are used as precursor for the matrix material. However, for hydrazinium nitroformate these precursors were not used, as they were deemed unsuitable for combination with hydrazinium nitroformate (U.S. Pat. No. 3,658,608 and U.S. Pat. No. 3,708,359). It was expected that the hydrazinium nitroformate combination with the polybutadiene would be unstable, due to reaction of the hydrazinium nitroformate with the double C=C bond.

The present invention is based on the surprising discovery that it is possible to combine hydrazinium nitroformate with hydroxyl terminated unsaturated hydrocarbon compounds and accordingly the invention is directed to a stable solid propellant for rocket motors, comprising a cured composition of hydrazinium nitroformate and an unsatured hydroxyl terminated hydrocarbon compound.

A chemically stable solid propellant, with sufficient shelf life for practical use can be obtained, provided that hydrazinium nitroformate of high purity is used, which can, among others, be realized by improvements in the production process like the use of pure starting materials, containing substantially less impurities (e.g. chromium, iron, nickel, copper, and oxides of the metals, ammonia, aniline, solvent and the like).

A chemically stable material shows absence of spontaneous ignition during storage at room temperature (20° C.) of at least 3 months, although it is preferred to have an absence of spontaneous ignition for at least 6 months, more preferred one year.

A further improvement in the stability of the solid propellant can be obtained by using hydrazinium nitroformate which contains substantially no hydrazine or nitroform in unreacted form. This can for example be obtained by changes in the production process, as discussed in WO-A 9410104 and a strict control of the addition rate of hydrazine and nitroform during the production of hydrazinium nitroformate, resulting in a purity of the recrystallised hydrazinium nitroformate between 98.8 and 100.3, based on $H_3O^+$ and a pH-value of a 10 wt. % aqueous solution of hydrazinium nitroformate of at least 4. Further, the water content of the different propellant ingredients, especially the water content of the binder components influences the stability and accordingly a water content of less than 0.01 wt. % in the binder is preferred. In addition to the aforementioned aspects, stabilisers may be added to further improve the shelf-life.

Further important variables in the production of the solid propellant are the selection of the curing temperature of the matrix material, the choice of the curing agent and the curing catalysts and inhibitors.

The solid propellant combinations according to the invention have various advantages. They possess an increased performance, expressed as an increased specific impulse for rocket applications and as an increased ramjet specific impulse for gasgenerator applications. The ramjet specific impulse is defined as: $I_{sp,r}=(I=\phi)I_{sp}-\phi U_0/g$.

In which $\phi$ is the weight mixture ratio of air and gas generator propellant, $I_{sp}$ is the specific impulse with ambient air as one of the propellant ingredients and $U_0$ is the velocity of the incoming air.

As the energy content of the system is high, it may become possible to use less oxidiser, thereby increasing the overall performance.

Further, it is to be noted that the material is chlorine free, which is an advantage from both corrosion and environmental considerations.

Depending on the actual use various compositions of the solid propellant according to the invention are possible. According to a first embodiment a solid propellant can comprise 80 to 90 wt. % of hydrazinium nitroformate, in combination with 10 to 20 wt. % of binder (hydroxyl terminated unsaturated hydrocarbon and other standard binder components, such as curatives, plasticisers, crosslinking agents, chain extenders and anti-oxidants). In case a fuel additive, such as aluminium is added, 10 to 20% of the hydrazinium nitroformate in the above composition can be replaced by the additive. These formulations are especially suited as rocket propellants with improved performance.

For the purpose of a gas generator propellant for ramjets or ducted rockets, the following combinations are preferred. 20 to 50 wt. % of hydrazinium nitroformate, combined with 50 to 80 wt. % of hydroxyl terminated unsatured hydrocarbon. As in the above composition it is also possible to use an amount of fuel additive for increased performance, such as Al, B, C and $B_4C$, whereby this fuel additive may be present in 10 to 70 wt. %, in combination with 10 to 70 wt. % of the hydrocarbon, keeping the amount of hydrazinium nitroformate identical.

As indicated above, the solid propellant is prepared from a cured composition of hydrazinium nitroformate and a hydroxyl terminated unsatured hydrocarbon. The hydrazinium nitroformate preferably has the composition described above, whereby the amount of impurities is kept at a minimum.

The binder or polymeric matrix material is prepared from a hydroxyl terminated unsaturated hydrocarbon. In view of the production process of the solid propellant this hydrocarbon preferably has a low molecular weight, making it castable, even when containing substantial amounts of solids. A suitable molecular weight for the hydrocarbon ranges from 2000 to 3500 g/mol. After blending the solid hydrazinium nitroformate with the liquid hydrocarbon it can be poured in a container and cured.

Curing is preferably carried out by crosslinking the hydroxyl terminated hydrocarbon, preferably hydroxyl terminated polybutadiene, with a polyisocyanate. Suitable polyisocyanates are isophorone-di-isocyanate, hexamethylene diisocyanate, MDI, TDI, and other polyisocyanates known for use in solid propellant formulations, as well as combinations and oligomers thereof. In view of stability requirements it is preferred to use MDI, as this provides the best stability (longest shelf-life). The amounts of hydrocarbon and polyisocyanate are preferably selected in dependence of the structural requirements so that the ratio of hydroxyl groups in the hydrocarbon and the isocyanate groups is between 0.7 and 1.2. Curing conditions are selected such that an optimal product is obtained by modifying temperature, curing time, catalyst type and catalyst content. Examples of suitable conditions are curing times between 3 and 14 days, temperatures between 30 and 70° C. and use of small amounts of cure catalysts, such as DBTD (<0.05 wt. %).

In case further fuel additives are included in the propellant these are added prior to curing.

Generally speaking, also minor proportions, especially up to no more than 2.5 wt. % of substances such as phthalates, stearates, metal salts, such as those of copper, lead, aluminium and magnesium, said salts being preferably chlorine free, such as nitrates, sulfates, phosphates and the like, carbon black, iron containing species, commonly used stabiliser compounds as applied for gun propellants (e.g. diphenylamine, 2-nitrodiphenylamine, p-nitromethylaniline, p-nitroethylaniline and centralites) and the like are added to the propellant combinations according to the invention. These additives are known to the skilled person and serve to increase stability, storage characteristics and combustion characteristics.

The invention is now further elucidated on the basis of the following examples.

EXAMPLE 1

Cured samples of HNF/HTPB formulations with different polyisocyanates and additives have been prepared. Typical examples are shown in table 1, showing the stability of the compositions as a function of time and temperature.

For all cured samples (unless stated differently): NCO/OH=0.900; curing time is 5–7 days at 40° C., after which samples are either stored for an additional week at 40° C., or at 60° C. for 1–2 days; solid load 50 wt %; additives 2 wt % (and 48 wt % HNF), unless stated differently.

| Composition | Additives | Time @ 40° C. [days] | Mass loss @ 40° C. [wt %] | Time @ 60° C. [days] | Mass loss @ 60° C. [wt %] | VST[a] [ml/g] |
|---|---|---|---|---|---|---|
| HNF | — | 7/14 | 0.09/0.16 | 2 | 0.40 | 1.73 |
| HNF/HTPB[b] | — | 7/13 | 0.23/0.39 | 2 | 1.76 | — |
| +IPDI[c] | — | 7/14 | 0.21/0.70 | — | — | 15.4 |
| +IPDI[d] | — | 6/13 | 0.47/1.05 | — | — | 10.4 |
| +IPDI[d] | DBTD[d] | 6/13 | 0.48/0.97 | — | — | 16.4 |
| +IPDI | — | 7/14 | 0.21/0.78 | 1 | 4.21 | — |
| +IPDI | pNMA | 7/13 | 0.16/0.31 | 1 | 2.51 | — |
| +IPDI | Aerosil | 7/13 | 0.21/0.84 | 1 | 4.05 | — |
| +Desm N100 | — | 7/14 | 0.11/0.16 | 2 | 6.70 | 16.1 |
| +Desm N100 | pNMA | 7/13 | 0.17/0.25 | 1 | 1.65 | — |
| +Desm N100 | Aerosil | 7/13 | 0.17/0.19 | 1 | 1.03 | — |
| +Desm W | — | 7/14 | 0.06/0.19 | 2 | 4.41 | — |
| +TDI | — | 7/14 | 0.28/0.74 | — | — | — |
| +Desm VL | — | 7 | 0.130 | 2 | 1.963 | — |
| +Desm VL | $Al(OH)_3$ | 7 | 0.168 | 2 | 0.228 | — |
| +Desm VL | pNMA | 7 | 0.121 | 2 | 0.265 | — |
| +Desm VL | $MgSO_4$ | 7 | 0.035 | 2 | 0.184 | — |
| +Desm VL | pNMA + $MgSO_4$ | 7 | 0.086 | 2 | 0.128 | — |
| +Desm VL | pNMA + $MgSO_4$ | 6 | 0.086 | 2 | 0.260 | 0.73 |
| +DOA[e] + Desm VL | pNMA + $MgSO_4$ | 6 | 0.131 | 2 | 0.470 | 0.76 |
| HNF/urethane[f] | — | 12 | 1.15 | 2 | 0.76 | 1.24 |

[a]Vacuum stability test (VST) conditions: 48 hrs @ 60° C.
[b]Uncured sample.
[c]Different lots of HTPB and HNF were used; the NCO/OH ratio is 1.200 (instead of 0.900); curing time 1 day at 40° C.
[d]Different lot of HTPB was used; 0.01 wt % DBTD was added as a cure catalyst.
[e]DOA content: 20 wt % (on binder).
[f]Sample containing a 50/50 wt % mixture of HNF and rasped HTPB/IPDI binder (NCO/OH = 0.900).

EXAMPLE 2

HNF/HTPB as a High Performance Propellant Composition

In table 2 the specific impulse of HNF/HTPB and NF/AL/HTPB combinations are presented. Similar AP based compositions are presented for reasons of comparison. From table 2, it becomes apparent that HNF/AL/HTPB compositions possess higher specific impulses compared to AP/AL/HTPB compositions of similar solid load, whereas the HNF/HTPB composition has the additional advantage of low smoke properties due to the abundance of Al in the composition (at cost of some performance loss).

TABLE 2

| | Specific impulse(s) | | | |
|---|---|---|---|---|
| Solid load w % | AP/HTPB | HNF/HTPB | AP/AL/HTPB (19% AL) | HNF/AL/HTPB (19% AL) |
| 80 | 276.6 | 290.8 | 314.2 | 327.3 |
| 82 | 283.1 | 296.9 | 318.6 | 330.8 |
| 84 | 289.9 | 303.4 | 324.8 | 334.3 |
| 86 | 296.9 | 310.2 | 329.1 | 338.2 |
| 88 | 303.6 | 317.2 | 331.7 | 344.4 |
| 90 | 309.0 | 324.1 | 332.9 | 348.8 |

Table 2. Comparison of the theoretical performance of HNF/HTPB propellants compared to conventional AP/HTPB propellants (NASA CET 89 calculations, vacuum specific impluse, chamber pressure 10 MPa, expansion ratio 100, equilibrium flow conditions).

EXAMPLE 3

HNF/HTPB as a high performance fuel for a ducted rocket gas generator for ramjet applications. In Table 3 the ramjet specific impulses of a 30% and a 40% solids HNF/HTPB are listed in comparison to 40% solids AP/HTPB fuel and a GAP for ducted rocket gas generator propellants. In ducted rockets, fuel rich reaction products of a propellant are injected into a combustion chamber where it reacts with oxygen from the incoming air.

From Table 3 it becomes apparent that HNF/HTPB compositions possess higher ramjet specific impulses compared to other compositions which are momentary under consideration for ramjet fuel applications. In addition to high performances, HNF/HTPB has the additional advantages that it has a low signature (HCl free exhaust), potentially a high pressure exponent, increasing the gas generator throtteability and possibly lower oxidator loadings compared to AP-based gas generators, resulting in overall performance gains.

TABLE 3

| | Ramjet specific impulse (s) | | | |
|---|---|---|---|---|
| Oxygen/ fuel ratio | GAP | AP/HTPB (40% solids) | HNF/HTPB (40% solids) | HNF/HTPB (30% solids) |
| 2.5 | 369.1 | 298.6 | 304.3 | 289.6 |
| 10 | 743.0 | 901.9 | 936.0 | 1010.0 |
| 15 | 785.6 | 981.5 | 1023.4 | 1121.1 |
| 20 | 799.3 | 1022.1 | 1070.1 | 1182.3 |
| 30 | 783.1 | 1044.8 | 1100.7 | 1234.7 |
| 40 | 737.3 | 1025.7 | 1087.2 | 1236.4 |

Table 3. Ramjet specific impulse for three different ducted rocket gas generator propellants (NASA CET 89 calculations, chamber pressure 1 MPa, exit pressure 0.1 MPa, exit pressure 0.1 MPa, sea level at 2.5 M, equilibrium flow conditions).

What is claimed is:

1. A solid propellant for rocket motors, gas generators and comparable devices, comprising a cured composition of solid hydrazinium nitroformate, an unsaturated hydroxyl terminated hydrocarbon compound binder and a curing agent, wherein the hydrazinium nitroformate when dissolved in water as a 10 wt. % aqueous solution prior to being incorporated into the propellant has a pH of at least 4.

2. Propellant according to claim 1, wherein hydroxyl terminated polybutadiene is used as the unsaturated hydroxy terminated hydrocarbon compound.

3. Propellant according to claim 2, wherein the molecular weight of the uncured hydroxyl terminated polybutadiene is between 2000 and 3500 g/mol.

4. Propellant according to claim 1, wherein the hydrazinium nitroformate is prepared from hydrazine and nitroform in substantially equimolar ratios.

5. Propellant according to claim 4, wherein the molar ratio of hydrazine to nitroform ranges from 0.99:1 to 1:0.99.

6. Propellant according to claim 1, wherein the curing agent comprises a polyfunctional isocyanate.

7. Propellant according to claim 6, wherein the polyfunctional isocyanate is a polyisocyanate is selected from the group consisting of isophoron di-isocyanate, hexamethylene di-isocyanate, methylene, diphenyl, disocyanate, toluene 2,4-disocyanate and oligomers thereof.

8. Propellant according to claim 1, wherein a stabilizing agent is present in the composition, selected from the group consisting of magnesium salts, aluminum salts, diphenylamine, 2-nitrodiphenylamine, p-nitromethylaniline, p-nitromethylaniline, centralites and combinations thereof.

9. Propellant according to claim 1, wherein the hydrazinium nitroformate has a purity of between 98.8 and 100.3, based on $H_3O^+$ and pH-value of a 10 wt. % aqueous solution of hydrazinium nitroformate of at least 4.

10. The propellant of claim 7, wherein said polyisocyanate is methylenediphenyldisocyanate.

11. A process for the preparation of a propellant of claim 1 comprising curing a composition comprising hydrazinium nitroformate having a pH of at least 4 when dissolved in water as a 10 wt % aqueous solution prior to curing, an unsaturated hydroxy terminated hydrocarbon and curing agent optionally in the presence of an accelerator for the curing agent.

12. Process of claim 11 wherein said composition is cured in the presence of an accelerator for the curing agent.

13. In a rocket motor, the improvement comprising using as the solid propellant a cured composition of claim 1.

14. A propellant of claim 1 wherein the curing agent and hydrocarbon have a water content less than 0.01 wt %.

15. A solid propellent for rocket motors, gas generators and comparable devices comprising a cured composition of containing hydrazinium nitroformate, an unsaturated hydroxyl terminated hydrocarbon compound binder and a curing agent, said propellant being obtained by preparing a mixture of solid hydrazinium nitroformate, an unsaturated hydroxyl terminated hydrocarbon compound binder and a curing agent, followed by curing said mixture, the solid hydrazinium nitroformate, prior to being incorporated into the propellant, having a pH of at least 4 when dissolved in water as a 10 wt. % aqueous solution.

* * * * *